United States Patent [19]

McMillan

[11] Patent Number: 4,775,276

[45] Date of Patent: Oct. 4, 1988

[54] LOADER ATTACHMENT FOR HANDLING AND TRANSPORTING UTILITY POLES AND CYLINDRICAL ARTICLES

[75] Inventor: Joseph C. McMillan, Greensboro, N.C.

[73] Assignee: Industrial Truck Sales & Service, Inc., Greensboro, N.C.

[21] Appl. No.: 51,510

[22] Filed: May 18, 1987

[51] Int. Cl.[4] ..... B66F 19/00

[52] U.S. Cl. ..... 414/23; 224/309; 294/103.1; 414/731

[58] Field of Search ..... 224/309, 310, 326; 294/88, 103.1, 86.4; 414/23, 731

[56] References Cited

U.S. PATENT DOCUMENTS

| | | | |
|---|---|---|---|
| 2,757,037 | 7/1956 | Troyer | 294/88 |
| 3,074,447 | 1/1963 | Bombardier | 414/23 X |
| 3,204,795 | 9/1965 | Larson | 294/86.4 X |
| 3,439,818 | 4/1969 | O'Neil | 294/88 X |
| 3,630,246 | 12/1971 | Hamilton | 414/23 X |
| 4,243,258 | 1/1981 | Dauwalder | 294/88 |
| 4,451,194 | 5/1984 | Keats et al. | 414/731 |

FOREIGN PATENT DOCUMENTS

| | | | |
|---|---|---|---|
| 1402643 | 8/1975 | United Kingdom | 414/23 |

*Primary Examiner*—L. J. Paperner
*Assistant Examiner*—Janice Krizek
*Attorney, Agent, or Firm*—C. Robert Rhodes; Judith E. Garmon

[57] ABSTRACT

A utility pole handling attachment for skid-steer type loaders includes an hydraulically operated gripper arm and support cradle for receiving and gripping a utility pole during pulling or setting operations or transporting. The attachment is adapted to pivot the gripped pole along a path from a transport position wherein the pole is parallel to the longitudinal axis of the loader, to a pulling or setting position wherein the pole is substantially perpendicular to the longitudinal axis of the loader for installation into or removal from the ground.

7 Claims, 4 Drawing Sheets

LOADER ATTACHMENT FOR HANDLING AND TRANSPORTING UTILITY POLES AND CYLINDRICAL ARTICLES

BACKGROUND AND SUMMARY OF THE PRESENT INVENTION

The present invention is in the environment of handling utility poles, specifically apparatus for pulling and setting poles which are supporting electric power lines and the like. Many of these poles are thirty and forty feet in length and are sunk in the ground to a depth of six to eight feet minimum. Obviously a network of power lines and utility poles is present in all types of terrain and environments including heavily populated residential and commercial developments along with more sparsely populated rural areas. In the past, utility poles have been handled by means of large boom trucks with which utility companies move a load of poles to a centralized location and the boom is then used to lift the poles off the truck, after which the poles are manually transported to the site of installation. At repair or installation time, a new hole must be dug and the new pole set therein, prior to lifting the old utility pole out of the ground and carrying it back to the boom truck. This process alone can take several men a period of hours to perform, and does not include the task of transferring the wiring and other mechanical components from the old utility pole to the new pole. This procedure is generally done by a lineman physically climbing the old pole to release the wiring, and then a second man climbing the new pole to attach the wiring thereto.

As commerical and residential developments became more heavily populated, and in some areas of the country extremely dense, it became more and more difficult for the utility companies to make necessary repairs to existing utility poles or to install new networks of utility wires. The boom trucks which are conventionally used for handling the utility poles are large and because of the height of the operating boom the trucks require a substantial clearance in order to manipulate the poles. Further, because of the necessary clearance for the boom and because of the increasingly densely developed areas, it became necessary that the boom trucks be parked increasingly farther away from the actual installation site. Therefore, because of the time and expense involved with handling the utility poles, many times repairs were postponed until absolutely necessary, to the detriment of the utility system. The cost of manually handling the poles also substantially increases the cost of developing and installing new utility systems because as many as six to eight men might be tied up for hours to replace only one or two poles.

When some of the small scale earth and material moving equipment such as the skid steer loaders became available, attachments were available for these small loaders which could be used for digging holes for setting utility poles. However, there was no equipment available which could be used to transport the poles to or from the actual work site, and which could also lift the old pole out of the ground and then insert the new pole. It was originally believed that the small scale of these loaders would be detrimental or prohibitively dangerous in handling these extended length utility poles because of the weight and length of the pole. Originally the balance of the loader was believed to be compromised by the size of the utility poles. It was to overcoming these restrictions that the inventor turned in development of an attachment that could be used for transporting, lifting or pulling, and setting utility poles without compromising the balance and function of the loader.

The present invention is such a device and has been successfully tested in the environment of handling conventional wooden utility poles or the newer aluminum poles which are used for supporting streetlights and the like. The device is an attachment for the small loaders such as the Toyota, the Clark Bobcat TM, and other like machinery; which attachment can be utilized to support a utility pole that is placed thereon by a boom truck, and after reaching the installation site move the pole into position for setting in the ground. The same attachment is also utilized for grasping and pulling an old utility pole from the ground, pivoting it up and in position over the loader for transporting back to the primary supply truck where the pole is removed from the loader by a boom and placed on the truck.

The present invention is an hydraulically operated gripping and supporting mechanism that is attached to the loader. In use the gripper is centered around the utility pole, after which the hydraulic control is activated to close the gripping arm to engage the pole and hold it securely through the movement of pulling or setting. The gripping and supporting mechanism also secures the pole for transporting in a position wherein the pole is parallel to the longitudinal axis of the loader. The mechanism holds the pole without slippage during a pivotal movement from that position wherein the pole is parallel to the longitudinal axis of the loader, to a position wherein the pole is perpendicular to the longitudinal axis of the loader and thereby in a position for pulling or setting.

The improved handling mechanism additionally includes a plurality of removable stud devices on the gripping surfaces for improving the gripping action on aluminum or other types of materials which might have a slippery surface. The studs are also useful when handling wooden utility poles during wet or damp conditions.

The handling mechanism attachment itself is a self-contained attachment which is attached to the loader lift arm by a simple leverage action lock, taking only two to three minutes to remove one attachment (such as an auger used for digging the hole for the pole) and replace with the pole handling attachment. In addition to the aforementioned gripper, the mechanism includes a cradle in which the pole is supported during pivotal movement. Further, an auxillary, permanently mounted pole stabilizer means is attached to the upper surface of the loader to receive and stabilize the end portion of the utility pole during its transport position.

It is therefore a primary objective of the present invention to provide an apparatus for handling utility poles by attachment of the apparatus to small scale loaders and earth moving equipment. Another primary objective of the present invention was to provide such a handling mechanism on small scale equipment which could be utilized in densely populated and developed areas. Other objectives include the provision of an apparatus which could be attached to the selected loader and utilize hydraulic and steerage controls existing on the loader; the provision of a utility handling apparatus which could be quickly attached or detached from the loader by the operator, while remaining in the loader; and the provision of such a handling apparatus having a minimum number of components, thereby maximizing efficiency and dependability. Other objectives and advantages of the apparatus will become apparent to those skilled in the art as they study the following detailed description in conjunction with the accompanying drawings. In the drawings:

DETAILED DESCRIPTION OF A PREFERRED EMBODIMENT

Figure 1:
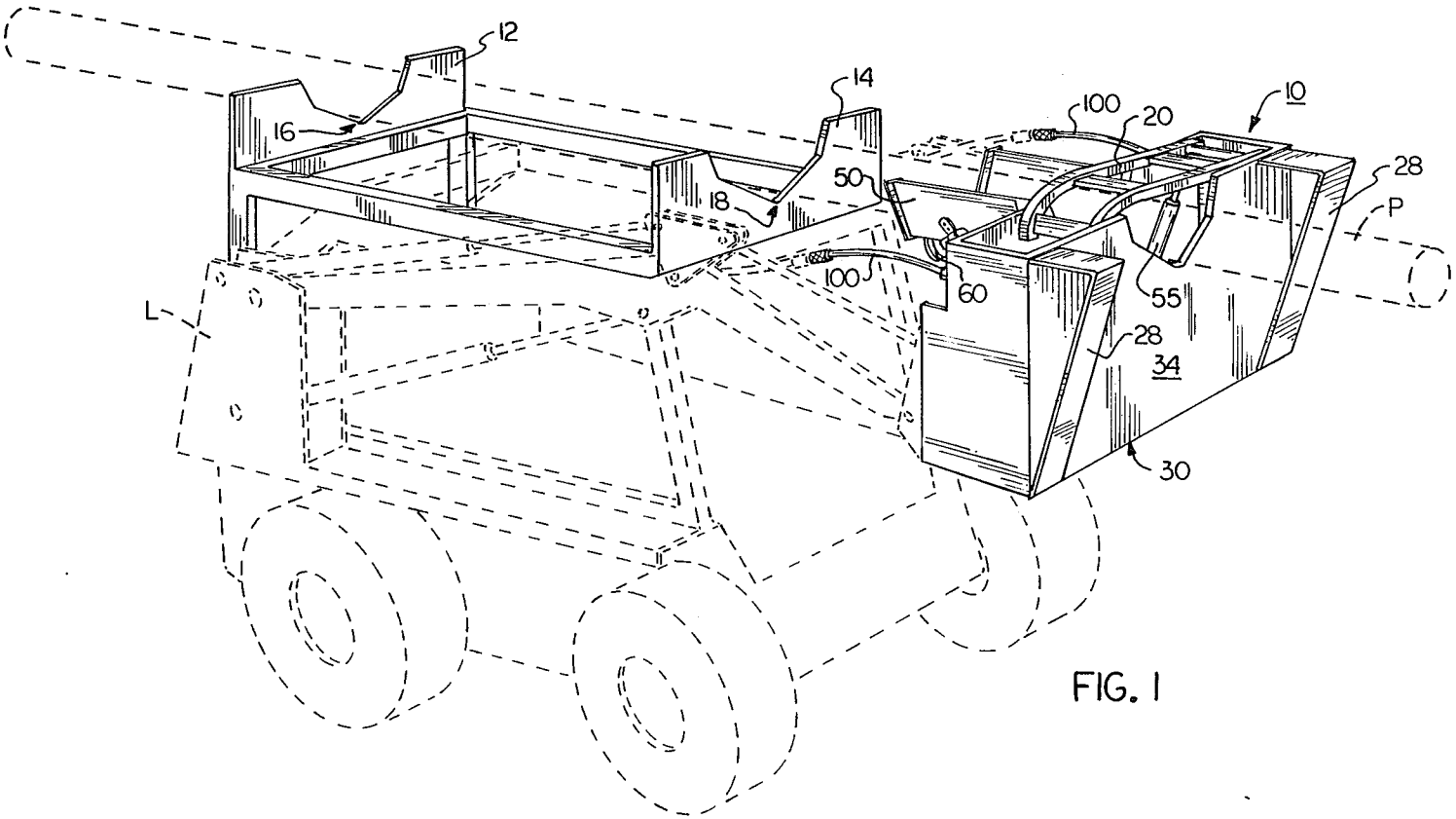
FIG. 1 is a perspective view of a conventional model of skid steer loader with the gripping and lifting attachment of the present invention attached thereto.

Looking first at FIG. 1, the utility pole handler 10 according to a preferred embodiment is shown as it is attached to a loader L of the type known by such names as the Toyota Skid Steer and the Clarke Bobcat TM. The relative position of the loader L, the handler 10 and the utility pole P are shown in the transport position wherein the pole P is held securely in the gripper portion of the handler 10, and the extended length rests in a notched pole stabilizer means comprised of supports 12 and 14, parallel to the longitudinal axis of the loader L. This is the position used for carrying poles to and from the above described boom truck or installation site.

Figure 6:
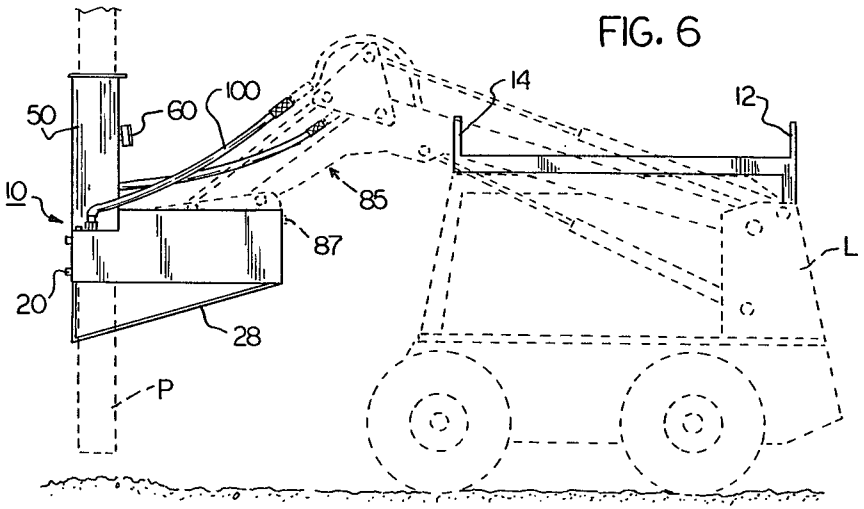
FIG. 6 is a side view of the loader and gripping and lifting apparatus with the utility pole in a position perpendicular to the longitudinal axis of the loader.
Figure 7:
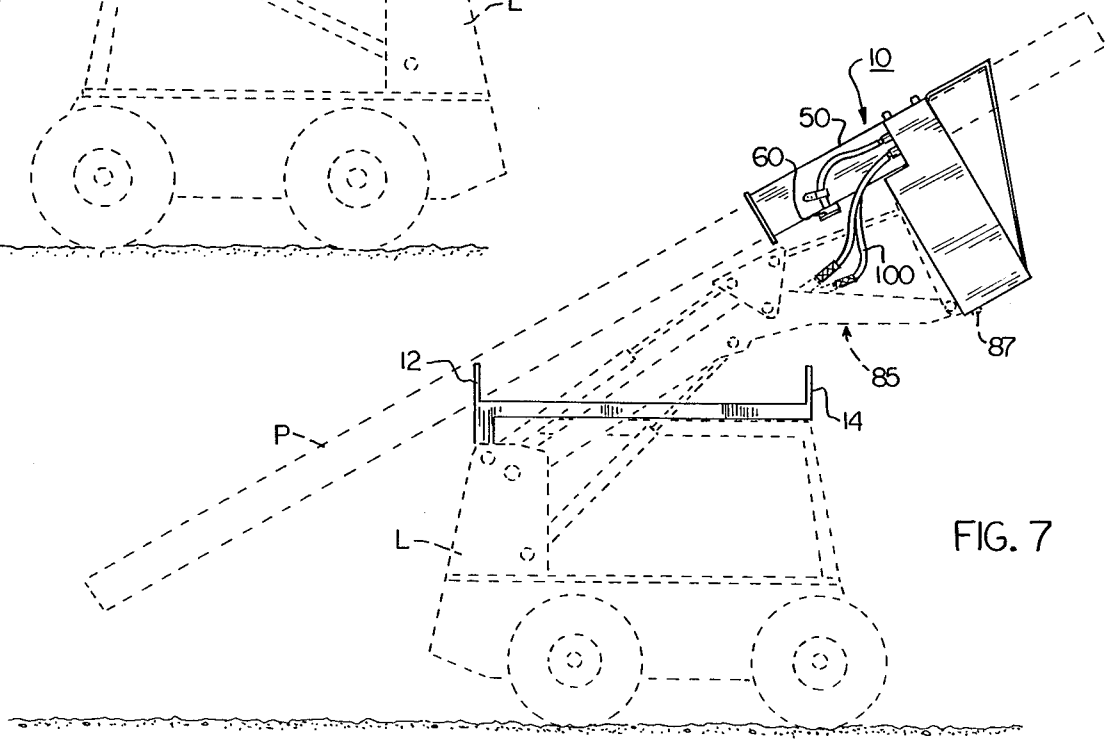
FIG. 7 is a side view of the loader with the gripping and lifting attachment and with the utility pole positioned at an angle behind and above the loader.

FIGS. 6 and 7 illustrate other operative pole positions including pulling and setting (FIG. 6) wherein the pole is upright, perpendicular to the longitudinal axis of the loader; or tilted above and behind the loader (FIG. 7) at approximately 45° to the ground.

Figure 2:
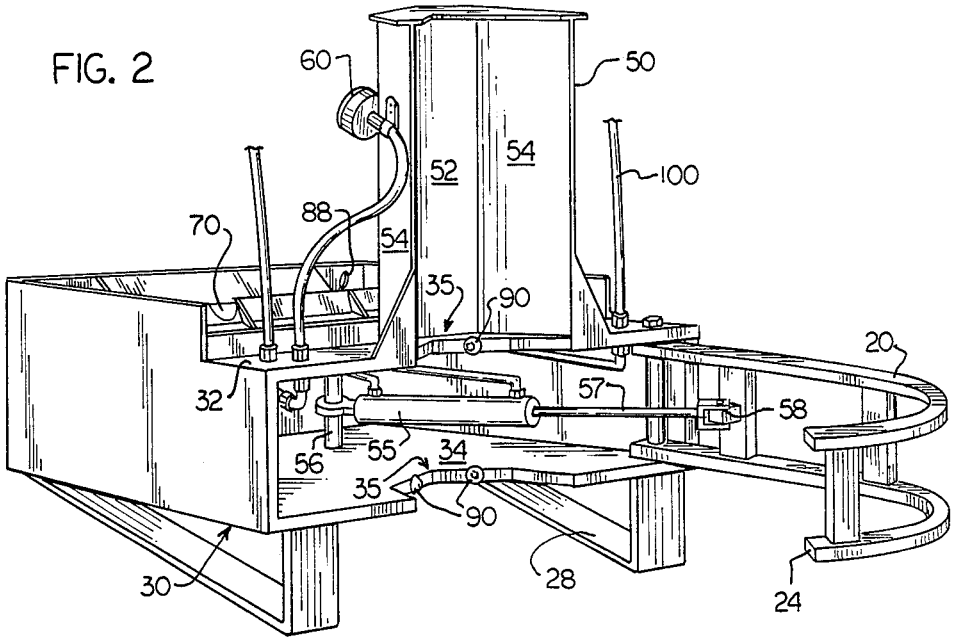
FIG. 2 is a perspective view of the gripping and lifting attachment in its open position for receiving a utility pole therein.

The handler 10 is detailed in FIGS. 2 through 5. FIG. 2 illustrates the handler 10 detached from the loader L. The principal components of the handler 10 are the hydraulic gripper arm 20, which is pivotally mounted in the structural housing 30, the support cradle 50, the hydraulic cylinder 55, and the attachment frame 70 which receives the lift arm 85 of the loader L.

Figure 3:
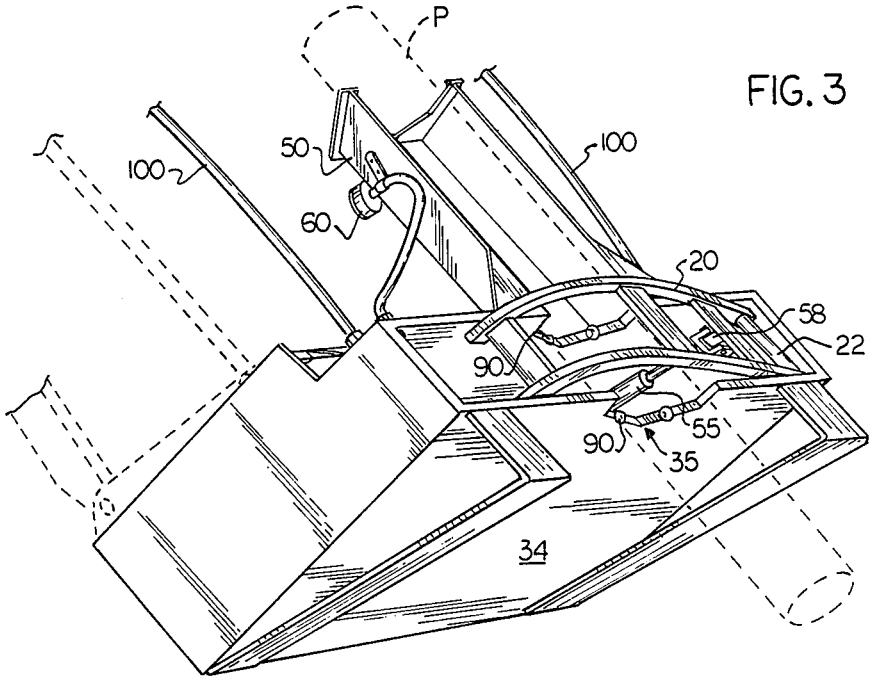
FIG. 3 is a perspective view of the gripping and lifting attachment in its closed position with the gripper engaged around a utility pole (in broken line)
Figure 4:
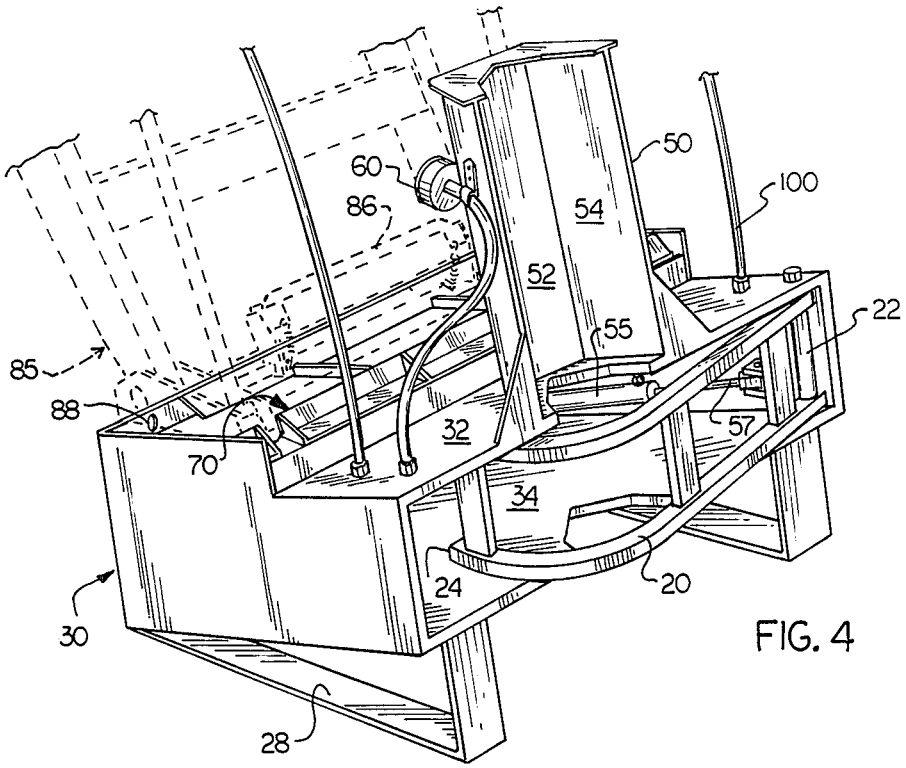
FIG. 4 is a perspective view of the gripping and lifting attachment in a closed position without the utility pole therein.
Figure 5:
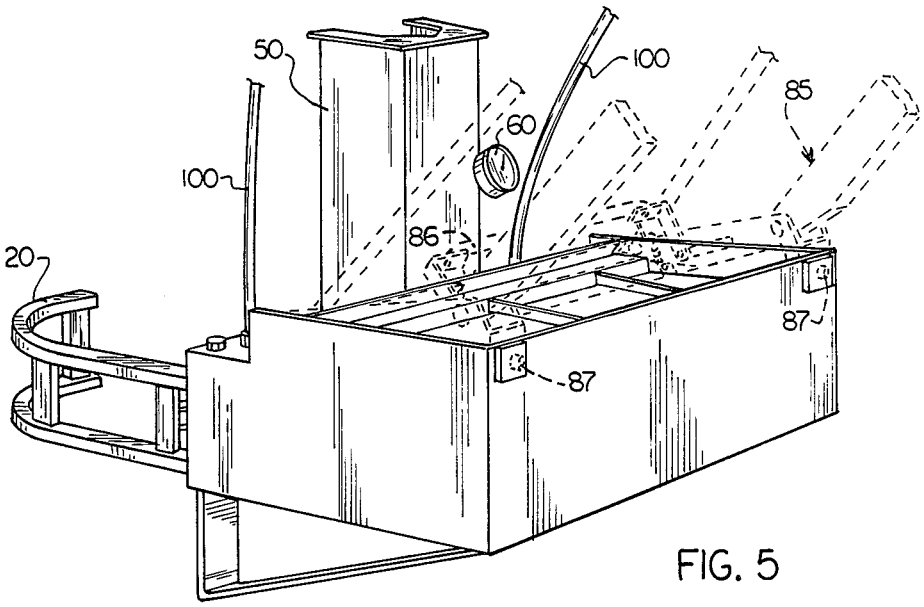
FIG. 5 is a perspective view taken from the rear of the embodiment shown in FIG. 3.

FIG. 2 further illustrates the handler gripper arm 20 in its open position whereby the pole P is received therein as shown in phanthom lines in FIG. 3. The gripper 20 pivots at connection 22 which is mounted between the upper and lower walls 32, 34 of structural housing 30.

The free end 24 of the gripper arm lies between the upper and lower walls when closed, to inhibit warping or twisting of the arm during use. Pivotal movement of the gripper arm 20 is activated by the hydraulic cylinder 55, responsive to hydraulic controls (not shown) on the loader. The cylinder 55 is mounted interiorly of structural housing 30, with a stationary connection pin 56, opposite the extensible push rod 57 which is connected to the gripper arm at a pivoting connector 58. A pressure gauge 60 is operatively coupled to the hydraulic controls to provide a constant readout of the gripping pressure during operation.

The pressure gauge indicator 60 is mounted on the side wall of the support cradle 50, facing away from the pole, with the face of the indicator always visible to the loader operator.

The handler 10 is mounted on the loader by use of the connector provided with the selected loader L. If, for example, the handler 10 is to be attached to a loader of the type made by Toyota Industrial Equipment, the attachment frame 70 is structured to receive the Toyota standard quick-change attachment mechanism that is connected to the lift arm 85. The attachment mechanism includes a spring mounted leveraged locking member 86 which is rotated into a locked position by pushing downward toward the housing 30. Although not shown in the drawings, the lever 86 may be locked into position by the operator while in the operator's cage, and upon activation the lever pushes locking pins 87, through apertures 88 (FIG. 2) to lock the attachment on the connector. Other connectors can be used with simple modification.

FIG. 3 illustrates a portion of pole P as gripped within the handler mechanism after pivotal movement of the mechanism has begun. The pole is gripped at a point generally near the end which is closest to the ground. The portion immediately adjacent the gripped portion is received in cradle 50. Cradle 50 is comprised of a floor portion 52 and adjoining, opposing side walls 54. The cradle stabilizes the pole, inhibiting any side-to-side rolling motion, or jackknifing out of position. The uppermost portions of the pole, as shown in FIG. 1, are received in notched, upwardly extending stabilizers or supports 12, 14 to further inhibit any pole movement. The stabilizers are mounted on the forward and rearward portions of the top of the operator cage as shown, and are comprised of metal plates (at least one but preferably two) which are welded or otherwise securely and permanently attached to the upper surface of the operator cage of the loader. The central portions of the plates are notched out at 16, 18 substantially along the same dimensions as the cradle 50, and positioned in alignment therewith such that the pole rests therein.

The gripping arm mechanism 20 remains tightly around the pole P as in FIGS. 1, 3, 6 and 7 during pulling, setting and transporting. The aforedescribed pressure gauge 60 constantly monitors and displays the gripping pressure in psi. To further secure the pole under poor conditions such as rain (or any other situation where the surface of the pole is slippery), a plurality of removable studs 90 are engaged in the upper and lower walls 32, 34 of the housing, extending outwardly from the inner surface of the notches 35 which are cut out of these walls. The studs 90 are elongated metal rods that are inserted in apertures in the surface of the notches 35 (through the thickness of the walls) and held in place by cotter pins which are not shown. Thus mounted the studs extend outwardly into the notched area and bite into the pole P when gripped by arm 20.

As a further means for increasing frictional contact with pole P, a portion of the inner surfaces of cradle 50 may be lined with rubberized pads or plates. The pads may be permanently attached by any conventional means or may be removably attached for use under wet or slippery conditions.

In use, after the handler 10 is operatively attached to the lift arm 85, and to the hydraulic lines 100, the gripper arm 20 is opened to receive a pole P from the supply truck or the loader may be moved into position to pull a pole from the ground. FIG. 6 illustrates this pulling/-setting position, from which the pole is pivoted backwardly to rest on supports 12, 14 as shown in FIG. 1. In some instances the operator may find it desirable or necessary to attach or removing wiring components to or from the pole while the pole is on the loader. To do so, the pole P may be pivoted backwardly and downwardly, behind the loader L, as shown in FIG. 7 or stopped in front of the loader as shown in FIG. 3. Thus positioned, access to either end of pole P is available for performance of work thereon. The operation of the lift arm 85 throughout its pivotal path of movement is conventional and is not described herein. The quick attachment means previously described, also conventional, provides for pivotal motion of the handler 10 relative to the lift arm.

All of the structural housing 30, ground supports 28, gripper arm 20 and the cradle and stabilizing supports are preferably made from a heavy gauge steel. All couplings, hydraulic connector lines, and the like are conventional. The handler 10, although described for handling utility poles, would be useful in handling other cylindrical articles, and therefore utility is not limited to the description herein. Other and further modifications are possible to those skilled in the art, while remaining within the scope of the claims below.

What is claimed is:

1. An attachment for a skid-steer type loader which loader has a longitudinal axis extending along the direction of travel of the loader; said attachment comprising a handling mechanism for utility poles and other elongated cylindrical articles; said handling mechanism including:

(a) a structural housing having upper, lower and adjoining side walls;

(b) a gripping arm pivotally mounted on said housing and movable between a first, open position for receiving a utility pole therein and a second, closed gripping position wherein the pole is securely gripped between said gripping arm and a portion of said housing;

(c) said upper and lower walls being co-extensive in relationship to each other and spaced a prescribed distance apart; each of said upper and lower walls having terminal forward edges; said gripping arm having a pivotal mounting means extending between said upper and lower walls at a point adjacent said terminal forward edges and adjacent and parallel to one of said housing side walls; said gripping arm having a height substantially equivalent to the distance between said upper and lower walls; the free end of said gripping arm, opposite said pivotal mounting means, lying substantially inside said terminal forward edges of said upper and lower walls when said gripping arm is in said closed position;

(d) means associated with the housing for receiving a portion of the utility pole adjacent the gripped portion and stabilizing the pole against lateral rolling or twisting during transport, pulling or setting;

(e) means for connecting said handling mechanism to the controls and hydraulic system of the loader, such that the movement of said handling mechanism and the opening and closing of said gripping arm are controlled by use of standard controls on the loader;

(f) said handling mechanism being mounted on the lift arm of the loader and further including pivot means such that said handling mechanism pivots the gripped utility pole from a first, transport position parallel to said longitudinal axis of the loader to a second pulling or setting position substantially perpendicular to said longitudinal axis, or the reverse;

whereby a utility pole may be pulled from the ground, set into the ground, and/or transported to or from a supply site by means of said loader and attached handling mechanism.

2. A utility pole handling mechanism according to claim 1 and further including an hydraulic cylinder operatively connected between said gripping arm and the hydraulic controls on the loader, for moving said gripping arm from said first to said second, or the reverse, positions.

3. A utility pole handling mechanism according to claim 1 wherein said means for receiving and stabilizing the pole is comprised of a cradle member mounted on said housing and having a bottom wall, side walls and an open top and ends; said bottom and side walls extending parallel to the pole when the pole is gripped by said gripper arm.

4. A utility pole handling mechanism according to claim 3 wherein each of said terminal forward edges of said upper and lower walls includes a notched area in the mid-portion thereof for surrounding a portion of the utility pole; and said cradle member being mounted on said upper wall with said open ends of said cradle member in alignment with said notched areas, thereby increasing the effective length of said means for receiving and stabilizing the pole.

5. A utility pole handling mechanism according to claim 4 and further including a plurality of removable studs mounted along the inner surfaces of said notched areas, to bite into the utility pole and prevent slippage thereof.

6. A utility pole handling mechanism according to claim 1 and further including a pole stabilizer means mounted on the top of the loader for receiving and supporting the extended length of the pole during transport.

7. A utility pole handling mechanism according to claim 6 wherein said stabilizer means is comprised of at least one support plate extending upwardly from a selected position on the top of the loader; said support plate including an openly notched area in the mid-portion thereof for receiving the pole when in said transport position.

* * * * *